US008854785B2

(12) United States Patent
Poshman et al.

(10) Patent No.: US 8,854,785 B2
(45) Date of Patent: Oct. 7, 2014

(54) SURGE PROTECTION ARRANGEMENT

(75) Inventors: Göran Poshman, Vallentuna (SE); Jarmo Mäkinen, Vallentuna (SE)

(73) Assignee: Powerwave Technologies S.a.r.L., Luxembourg (LU)

( * ) Notice: Subject to any disclaimer, the term of this patent is extended or adjusted under 35 U.S.C. 154(b) by 653 days.

(21) Appl. No.: 12/471,244

(22) Filed: May 22, 2009

(65) Prior Publication Data

US 2009/0296296 A1 Dec. 3, 2009

Related U.S. Application Data

(60) Provisional application No. 61/128,710, filed on May 23, 2008.

(51) Int. Cl.

| | |
|---|---|
| ***H01C 7/12*** | (2006.01) |
| ***H01Q 1/50*** | (2006.01) |
| ***H01T 4/08*** | (2006.01) |
| ***H01R 24/48*** | (2011.01) |
| *H01R 13/66* | (2006.01) |

(52) U.S. Cl.

CPC .. *H01Q 1/50* (2013.01); *H01T 4/08* (2013.01); *H01R 13/6666* (2013.01); *H01R 24/48* (2013.01)

USPC ..... 361/117; 361/118

(58) Field of Classification Search

USPC ..... 361/117–120

See application file for complete search history.

(56) References Cited

U.S. PATENT DOCUMENTS

| | | | | |
|---|---|---|---|---|
| 4,099,217 | A | 7/1978 | Fitchew | |
| 4,554,608 | A | 11/1985 | Block | |
| 4,887,180 | A | 12/1989 | Climent et al. | |
| 5,508,873 | A | 4/1996 | Knapp et al. | |
| 5,844,766 | A | 12/1998 | Miglioli | |
| 5,860,812 | A * | 1/1999 | Gugliotti | 439/63 |
| 6,283,771 | B1 | 9/2001 | Mitchell et al. | |
| 7,014,480 | B1 * | 3/2006 | Weidner et al. | 439/95 |
| 7,471,172 | B2 * | 12/2008 | Holst et al. | 333/202 |
| 2002/0135963 | A1 | 9/2002 | Pagliuca | |
| 2004/0057186 | A1 * | 3/2004 | Chawgo | 361/118 |

FOREIGN PATENT DOCUMENTS

| | | |
|---|---|---|
| EP | 2 124 300 | 11/2009 |
| WO | 2004/097979 A1 | 11/2004 |

* cited by examiner

*Primary Examiner* — Danny Nguyen

(74) *Attorney, Agent, or Firm* — OC Patent Law Group; David L. Henty

(57) ABSTRACT

An improved surge protection for protecting an electronic device is disclosed, the device having a closed casing with walls made of a non-conducting material and being internally coated with a thin metallic layer. The device also has at least one connector, being arranged in an opening in the walls and including a connector body, at least a portion of which projects outwardly from the wall and which accommodates an internal coupling device, to which a transmission cable, including a central conductor and an outer shield conductor, is connectable. According to the invention, the connector body is also made of a non-conducting material and strong currents, being present at a conducting protection sleeve, are diverted by at least one conducting diversion member to at least one metallic structure, being in permanent electric contact with ground and having a high capacity of conducting strong currents. In use, the at least one conducting diversion member is in electrical contact with the protection sleeve, and extends radially outwardly from the protection sleeve, through the connector body, to the at least one metallic structure.

16 Claims, 8 Drawing Sheets

SURGE PROTECTION ARRANGEMENT

RELATED APPLICATION INFORMATION

This application claims the benefit under 35 U.S.C §119(e) of U.S. Provisional Patent Application Ser. No. 61/128,710, filed May 23, 2008.

FIELD OF THE INVENTION

The present invention relates to a surge protection arrangement as defined in the preamble of claim 1, i.e. being arranged for protecting an electronic device provided with

- a closed casing, the casing including side and bottom walls made of a non-conducting material and being internally coated with a thin metallic layer, and
- at least one connector, being arranged in an opening in one of the walls and including a connector body, at least a portion of which projects outwardly from the wall and which accommodates an internal coupling device, to which a transmission cable, including a central conductor and an outer shield conductor, is connectable.

RELATED ART AND BACKGROUND OF THE INVENTION

Electronic devices, such as filters, amplifiers, Current Injectors (CINs), motor drivers and other electronic equipment, need to be protected against strong currents. Such strong currents can occur, for instance, due to strikes of lightning and thunder.

Such electronic devices are, in order to secure a proper operation of the system, often located in environmental hostile locations, for example on high buildings or constructions, such as base station antenna masts and the like. By strikes of lightning or thunder, high currents run along all conducting structures and also along cables being connected to the devices, thereby threatening the entire device, including the casing and the connectors of the device as well as the electronic components within the casing. Thus, in, for instance, a coaxial cable, strong currents run in both an inner conductor and an outer conductor of the cable, thereby causing harmful differential pulses between these conductors. Such differential pulses have traditionally been counteracted by the use of active lightning protection devices, in which Gas Discharge Tubes (GDTs) or the like are used for absorbing the currents.

Traditionally, casings for such electronic devices have been made of metal or metal alloys, such as aluminum alloys, which have also protected the devices, since the metal cases then could be designed to be able to cope with such strong currents. Traditionally, by leading the strong currents through the casing, either between the connectors or to some robust grounded construction, the devices have been protected.

However, in order to make production costs as low as possible, it is advantageous to make the casings and other parts of these devices in less costly and more easily processed materials. Such a low cost material is, for instance, plastics. Such preferred low cost materials are all essentially non-conducting. However, many of the devices must have a metal coating, i.e. a thin layer of metal, being arranged on the inside of the plastic walls and other parts, in order to operate properly.

In this document, "conducting" means electrically conducting whereas "non-conducting" means electrically non-conducting, as is clear for a skilled person.

For such casings, being made of an essentially non-conducting material and being coated by a metal coating, the coating of the casing has to be protected against strong currents running through an outer shield conductor of a cable being connected to the electronic device. This can be done by the use of a passive lightning protection, letting the strong current bypass the casing. Such a passive lightning protection device, not including active components such as GDTs or the like, is known from prior art document WO 2004/097979. Preferably, an electronic device should include both a passive and an active lightning protection, in order to be properly protected against strikes of lightning.

FIG. 1 shows a prior art microwave transmission unit 100 from document WO 2004/097979, where the microwave transmission unit 100 is provided with a passive lightning protection arrangement. Here, a cabinet 110 of the unit is made of plastic and is coated with a thin metal layer, and the connectors 120, 121 are made of metal. In order not to destroy the metal layer of the coating, the unit is also provided with metal fittings 130 leading strong currents from the metal connectors 120, 121, through the fittings 130 and to a metal lightning conductor, preferably being located in the cover 111 of the cabinet, thereby leading the current away from the inside of the cabinet 110. The fittings 130 are fastened to the metallic connectors 120, 121 by the use of screws 131 being attached to a metallic plate 122 of the connectors 120, 121, thereby leading away strong currents being present on the shielding conductor of the connectors.

In WO 2004/097979, some parts of the microwave transmission unit 100, such as the connectors 120, 121 and the lightning conductor, such as the cover 111, still have to be made of metal in order to protect the unit, which add to the production costs. Thus, in this prior art unit, there is a problem how to achieve a low cost unit having a secure and efficient lightning protection.

Aim and Most Important Features of the Invention

It is a main object of the present invention to provide a passive surge protection arrangement that solves the above stated problem.

The present invention aims to provide an efficient surge protection arrangement, being less costly and easier to produce than the lightning protection devices known in the prior art.

The main object is achieved by a surge protection arrangement according to the characterizing portion of claim 1, i.e. the connector body is made of a non-conducting material, and the internal coupling device includes

- a conducting protection sleeve, in use being in electrical contact with the outer shield conductor of the transmission cable, and
- at least one conducting diversion member, in use being in electrical contact with the protection sleeve, and extending radially outwardly from the protection sleeve, through the connector body, to at least one metallic structure being in permanent electric contact with ground and having a high capacity of conducting strong currents.

The surge protection arrangement according to the present invention will offer a safe protection of an electronic device essentially entirely being made of a non-conducting material.

Thus, with the present invention, the casing as well as the connectors of the device can be made in a low cost non-conducting material, being easily manufactured, and still be safely protected against surges.

This is possible, according to the present invention, since the strong currents are diverted from the internal coupling device of the connector, through the non-conducting connector body, and to a metallic structure being in permanent electrical contact to ground and also having capacity of conducting strong currents. The strong currents are diverted to the metallic structure by a protection sleeve and a diversion member being in electrical contact with the protection sleeve and the metallic structure. By this arrangement, the strong currents are effectively led to run through the surge protection arrangement instead of through the coating of the casing and/or the connector body.

The metallic structure includes, in different embodiments of the invention, a metallic structure in the form of a mounting bracket, a support construction, a lid closing the casing, a trimming plate, and/or a grounding braid. These different embodiments of the present invention all efficiently protect the device from surges and have further different advantages relating to the mounting conditions for the device. These embodiments, for surge protection purposes, make use of parts already being present in the device, such as the lid or the trimming plate, or in the mounting situation, such as the mounting bracket and the support construction, which, of course, is very cost effective and requires no extra mounting space.

According to one embodiment of the present invention, the diversion member includes a metal strip, having a contact portion essentially corresponding in shape to the shape of an end portion of the protection sleeve. According to another embodiment of the invention, the shape of the end portion of the contact portion essentially corresponds to the shape of the external wall surface of the protection sleeve. These two embodiments offer very good electrical contact between the protection sleeve and the diversion member when they are pressed axially and radially against each other, respectively.

According to one embodiment of the present invention, the diversion member includes one or more screws. This is advantageous, since the screws can also be used for attaching the device to the mounting bracket or the support construction, or can be used for securing the lid to the casing.

Detailed exemplary embodiments and advantages of the surge protection arrangement according to the invention will now be described with reference to the appended drawings illustrating some preferred embodiments.

DETAILED DESCRIPTION OF PREFERRED EMBODIMENTS

Figure 1:
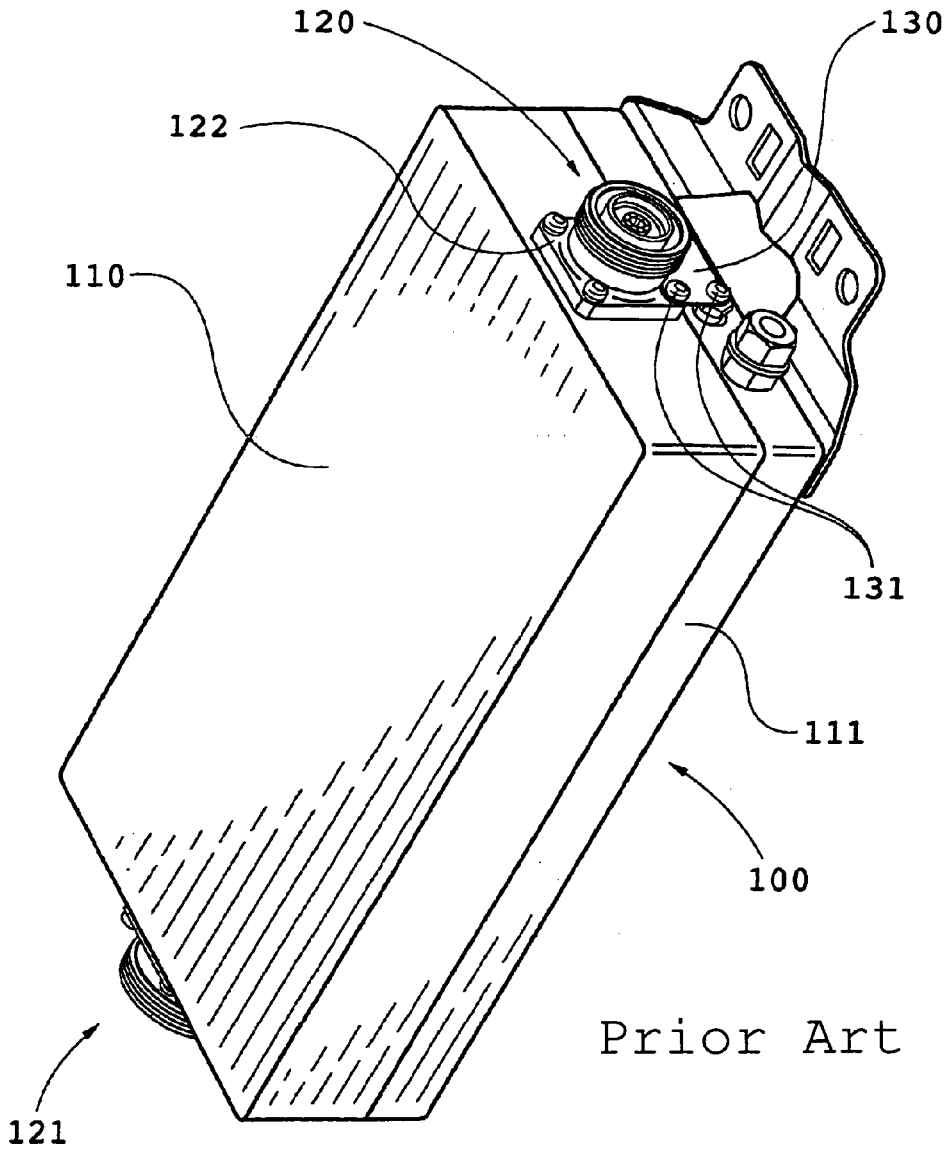
FIG. 1 shows an electronic device having lightning protection according to prior art.

FIGS. 2*a-d* show an electronic device 200 provided with a surge protection arrangement according to the present invention, protecting the device 200 against strong currents running through an outer shield conductor of a cable being connected to the electronic device.

In these figures, the same reference numbers are used for the same or corresponding components. The electronic device 200 has a closed casing, which includes side walls and bottom walls. These walls will hereafter generally be denoted casing walls 210. The casing is also provided with a lid 211 closing the casing. This lid 211 is according to one embodiment a regular lid closing the casing, and in another embodiment it also serves as a trimming plate for an RF-filter unit being enclosed within the casing. The device 200 is further provided with a first and a second connector 220, 221, each being arranged in an opening in the wall on which it is being arranged, and projecting outwardly from that wall.

Each of the first and second connectors 220, 221, basically includes the same parts, which will hereafter be explained for the first connector 220. The first connector 220 includes a connector body 222, and an internal coupling device 230 being accommodated within the connector body 222, when being assembled. The connector body 222 has, according to an embodiment of the invention, a cylindrical shape.

In this document, the word "cylindrical" should be interpreted in its broadest meaning, which, as is clear for a skilled person, includes cylinders having essentially any shape of its base area (cross section area). Thus, the "cylindrical" shape here, for instance, includes hollow cylinders having a circular cross section area, i.e. being tube-shaped. Also, since the "cylindrical" shape includes cylinders of essentially any cross section area, the connector body 222 can have a shape corresponding to essentially any transmission cable connector being connected to the connector body 222.

Figure 2A:
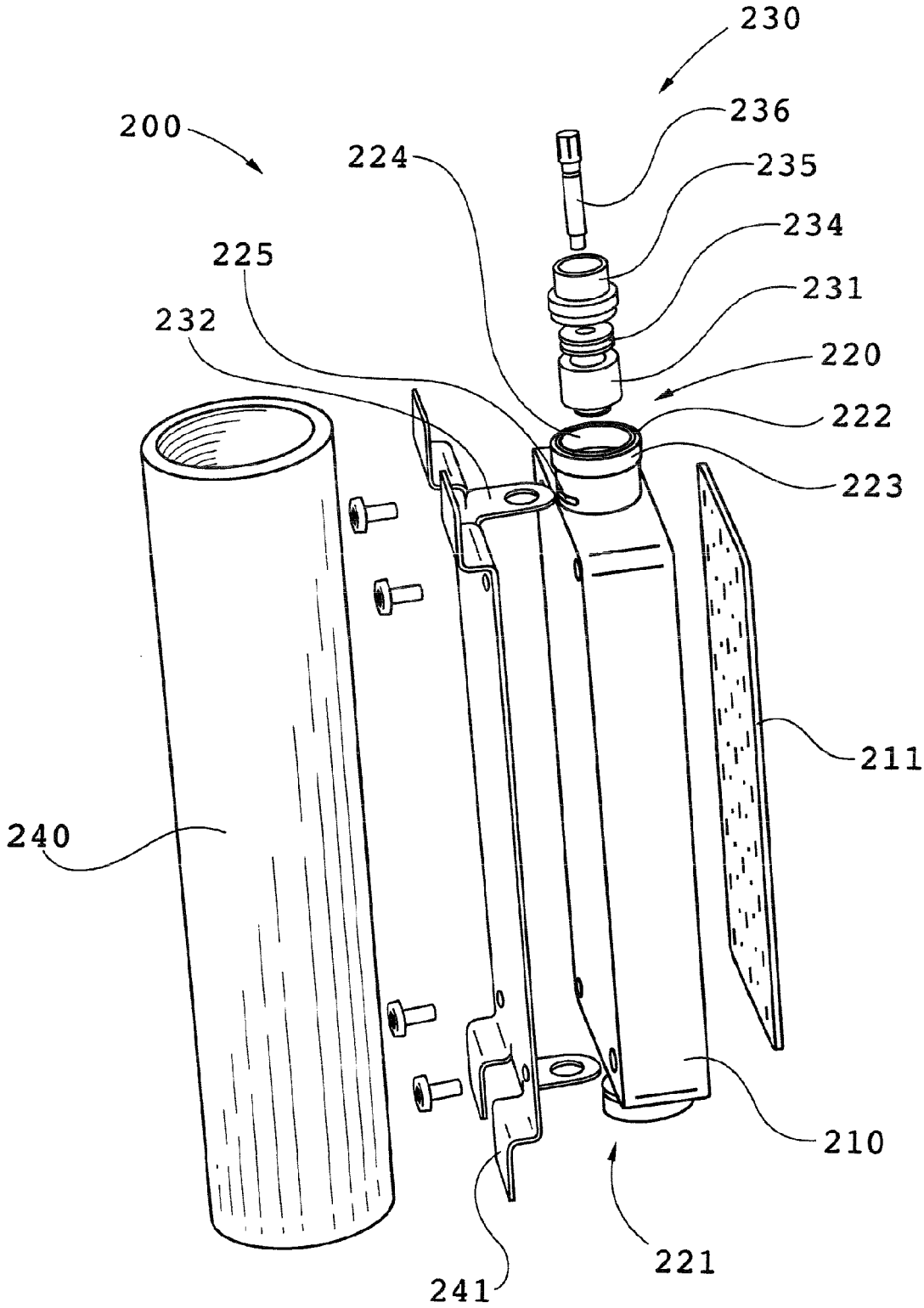
FIGS. 2*a-d* show an electronic device having a surge protection arrangement according to an embodiment of the present invention.
Figure 2B:
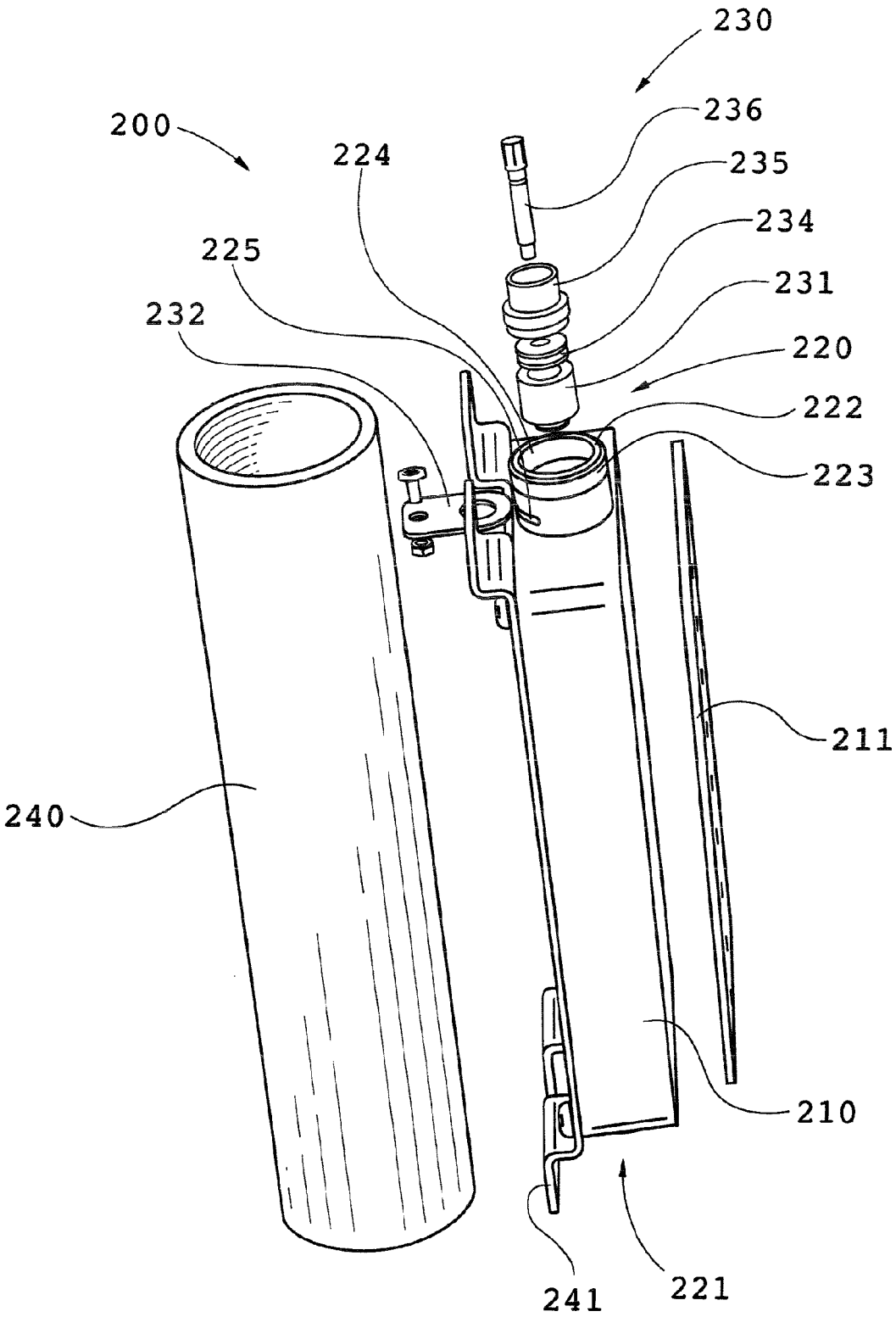

In FIGS. 2*a* and 2*b*, the internal coupling device 230 is shown to include a protection sleeve 231, a centre conductor pin 236, an isolator ring 234, a diversion member 232, and a coupling sleeve 235, all being shown disassembled for clarity. The different parts of the internal coupling device 230 will not be explained in detail in this document, since most of them are known to a person skilled in the art. However, the parts that are novel and are important for the function of the present invention will be explained below.

A transmission cable, such as a coaxial cable having a central conductor and an outer shield conductor, can be connected to the internal coupling device 230, so as to provide signals to and from the electronic device 200. Unfortunately, also strong currents, surges, may arrive at the electronic device through the outer shield conductor of the connected cable, and the electronic device has to be protected against such surges.

The electronic device 200 is mounted on a support construction 240, typically being a mast, a tower or another rigid construction. The support construction often also supports one or more antenna arrangements and/or some other kind of electronic equipment. The support construction 240, or at least a part of it, is preferably made of a conducting material.

The electronic device 200 is attached to the support construction 240 by the use of a mounting bracket 241 being fastened to the support construction 240 and to which the electronic device 200 is attached. The support construction 240, the mounting bracket 241, as well as the casing are here shown disassembled for clarity.

The casing walls 210, i.e. the side walls and the bottom wall, are made of a non-conducting material, being coated on the inside with a thin layer of a conducting material. The use of non-conducting materials has the advantage that the casing is less costly to produce and lighter than traditional casings. The coating on the inside of the casing walls is needed to provide the electronic device 200 with a signalling ground and also with a protection against exterior interference. However, the coating is very thin in relation to the surges resulting from strikes of lightning and thunder, and can not cope with such strong currents.

According to the present invention, at least one of the first and second connectors 220, 221 is also made of a non-conducting material. Thus, the connector body 222 is made of, for instance, plastic or the like. This further lowers the manufacturing costs and the weight of the device. But, at the same time, there also arises a problem how to protect the device 200 from surges. Since also the connector is made of non-conducting material, it is of no use, as was done in prior art solutions, to simply connect a surge bypassing member to the exterior parts of the connector, and thereby lead the surge away from the coating.

According to the present invention, at least one opening 225, such as an aperture, a slot, or a hole, is arranged in the connector body 222. Through this opening or openings, a conducting diversion member 232 is inserted such that it is in electrical contact with the conducting protection sleeve 231 of the internal coupling device 230. In use, the protection sleeve 231 is in electrical contact with the outer shield conductor of a cable being connected to the connector 220, as will be discussed below.

Further, the conducting diversion member 232 is also in electrical contact with a metallic structure, which is in permanent contact with ground. The diversion member 232 is thus in electrical contact with the protection sleeve 231 and also extends radially outwardly from the protection sleeve 231, through the connector body 222 and out to the metallic structure, such that it is in electrical contact with the metallic structure.

The metallic structure is made of a highly conducting material and thus has low impedance and a high capacity of conducting strong currents. Hereafter, the relation between the characteristics for the different parts of the electronic device to be protected and the parts of the surge protection arrangement is discussed.

Generally, the resistivity of a thin film is usually characterized by its surface resistivity $R_S$ expressed in ohm per square. The capability of the thin film to carry the surge current is determined by the narrowest portion of the film designed to conduct the surge current.

The sudden conversion of electrical energy into heat increases the temperature of the film and may achieve melting of the film. Most natural materials increase their resistivity with increasing temperature, which implies that the process leading to melting may be non-linear for a route the current is taking through such a material. However, if another parallel route exists, in which temperature is not increasing in a similar way, then most of the current may be diverted to this route, since the current always seeks out the route having the lowest resistance.

From this reasoning, it is clear that the parts of the surge protection arrangement, e.g. the conducting diversion member 232 and the metallic structure, should have a sufficient cross section, such that the energy being absorbed does not bring neither of the parts of the surge protection arrangement anywhere near their own melting temperatures or the melting temperature for the thin film being protected. It is also clear that, in order to provide protection of the film, the resistances of the surge protection arrangement should be sufficiently low.

Thus, the minimal cross section required by the parts of the surge protection arrangement depends on the physical properties of the material chosen. For most metals, these properties, such as resistivity, heat capacity etc., are well known. Therefore, hereafter the details are only exemplified for copper. From this non-limiting exemplification, a skilled person knows how this applies to other materials.

A conductor of copper with cross sectional area of only 1 $mm^2$ has a resistance of roughly 2 mOhm per dm. Such a piece of copper can store thermal energy on the order of 36 J by increasing its temperature by 100 K. Here, it is assumed that 36 J is obtained by a peak-current pulse of about 8.4 kA presuming a typical 10/350 pulse used for lightning protection tests, in accordance with the International Electrotechnical Commission (IEC) standards IEC 61204-1/IEC 61312-1.

This exemplified peak of the pulse current may appear a little low for a skilled person. However, it corresponds to the differential pulses appearing between the inner and outer conductor (being mentioned above in connection with prior art solutions), which pulses usually are taken care of by active differential protection circuitry not being part of the present invention. For the typical 10/350 current pulse of about 8.4 kA, it is sufficient to set the cross sectional area of the conductor to 1 $mm^2$. Correspondingly, 10 $mm^2$ would support 86 kA, which should be sufficient to carry most of the direct lightning strikes into a tower.

Note here that the sustainable peak current has a linear relationship to the cross sectional area of the lightning conductor, since the storable heat at given temperatures increases linearly at the same time as the resistance decreases by the inverse of the cross sectional area.

In the above numerical example, the characteristics used are 400 J/kgK for the heat capacity and 8960 $kg/m^3$ for the density. The electric parameters used is the rough $2*10^{-8}$ Ohm*m for the resistivity and an energy integral of 0.000254 for an ideal 10/350 unit current pulse over unit resistance. (The notation 10/350 refers to microseconds for front time and half amplitude decay time for the pulse, respectively, as specified in IEC 61204-1/IEC 61312-1.)

In this example, adaptation to allowance of increased final temperatures or the use of different material is readily done by adjusting the appropriate parameters. It can also be estimated, in contrast to the numerical examples given above, that a typical 35 micrometer thick copper foil of roughly 0.5 mOhm/square can sustain at most 500 A per mm width of a 10/350 pulse.

Therefore, if the interior of a typical 7-16 connector is coated with a metallic coating layer of such a thickness of copper, it is brought to melt at about 25 kA applied on the shield conductor, having a diameter of 16 mm. Thus, such a coating needs extra protection against currents, even though no headroom is accounted for due to possible current density concentrations caused by asymmetry.

Due to variations in the choice of materials, and variations in geometrical asymmetry and the choice of connectors, the present invention offers a good protection for thin conducting coating films, particularly for metallic coating layers being thinner than 0.2 mm. However, this thickness measure for the coating is not an exact limit. Thus, the invention also offers a secure protection for other thicknesses, i.e. for thicker metallic coating layers. Thus, in this document, a thin layer of conducting material, such as a thin metallic layer, is a layer being thin in relation to lightning currents. Typically these thin layers of conducting materials are thinner than 0.2 mm, but, as is clear to a skilled person, these layers can also be thicker than 0.2 mm.

On the other hand, as is well known for a skilled person, there is an economic advantage in being able to coat the casing with a metallic layer being as thin as possible, where the thickness of this layer is only limited to have a thickness exceeding the skin depth of the material, in accordance with well known RF (Radio Frequency) theory.

Thus, as was reasoned and exemplified above, since the current always takes the route having the lowest resistance, most of the current may be diverted to a route parallel to the route through the thin coating layer, if there is present a parallel route for which the temperature does not increase in the same way as for the thin metallic coating layer.

Therefore, by the arrangement shown in FIG. 2*a*, in accordance with an embodiment of the present invention, a surge running along the outer shield conductor of a cable being connected to the first connector 220 will, instead of running through the coating of the casing, run trough the protection sleeve 231, the diversion member 232 and to the metallic structure.

In the embodiment shown in FIG. 2*a*, the diversion member 232 is a metal strip being attached to the mounting bracket 241. Here, the metallic structure includes the mounting bracket 241, and the surge is diverted from the protection sleeve 231 to the mounting bracket 241 by way of the diversion member 232. From the mounting bracket 241, the strong currents of the surge are led either to the grounded support construction 240 or, if the device has more than one connector, possibly to the outer shield conductor of a second cable being connected to the second connector 221, the outer shield conductor of the second cable being in electrical contact with ground.

In the embodiment shown in FIG. 2*b*, the diversion member 232 is a metal strip being attachable to the support construction 240, by for example one or more screws or the like. According to this embodiment of the invention, the metallic structure includes the support construction 240, which is in permanent electric contact with ground and is able to conduct strong currents.

As is shown in FIGS. 2*a* and 2*b*, the diversion member 232 has, according to an embodiment of the invention, a contact portion, having a rounded end portion being provided with a central opening, resulting in a contact portion having an opening in the metal strip. The rounded end portion of the contact portion has a shape, which, when being inserted through the connector body 222 into the internal coupling device 230, essentially corresponds to the shape of the internal wall surface 224 of the connector body 222. Here, the opening in the metal strip has, in the embodiment shown in FIGS. 2*a* and 2*b*, a circular shape. However, according to another embodiment of the invention, the opening can have essential any shape fitting well together with the other parts of the internal coupling device 230.

By this shape of the contact portion, it fits very well into the other parts of the internal coupling device 230, when being assembled, and especially to the protection sleeve 231, such that an electrical contact with the protection sleeve 231 is achieved. The shape of the contact portion of the diversion member 232, including the opening, corresponds essentially to the shape of the end portion of the protection sleeve 231, which guarantees a solid electrical contact, when they are pressed axially against each other. The connection between the diversion member 232 and the protection sleeve 231 will be described further below.

Figure 2C:
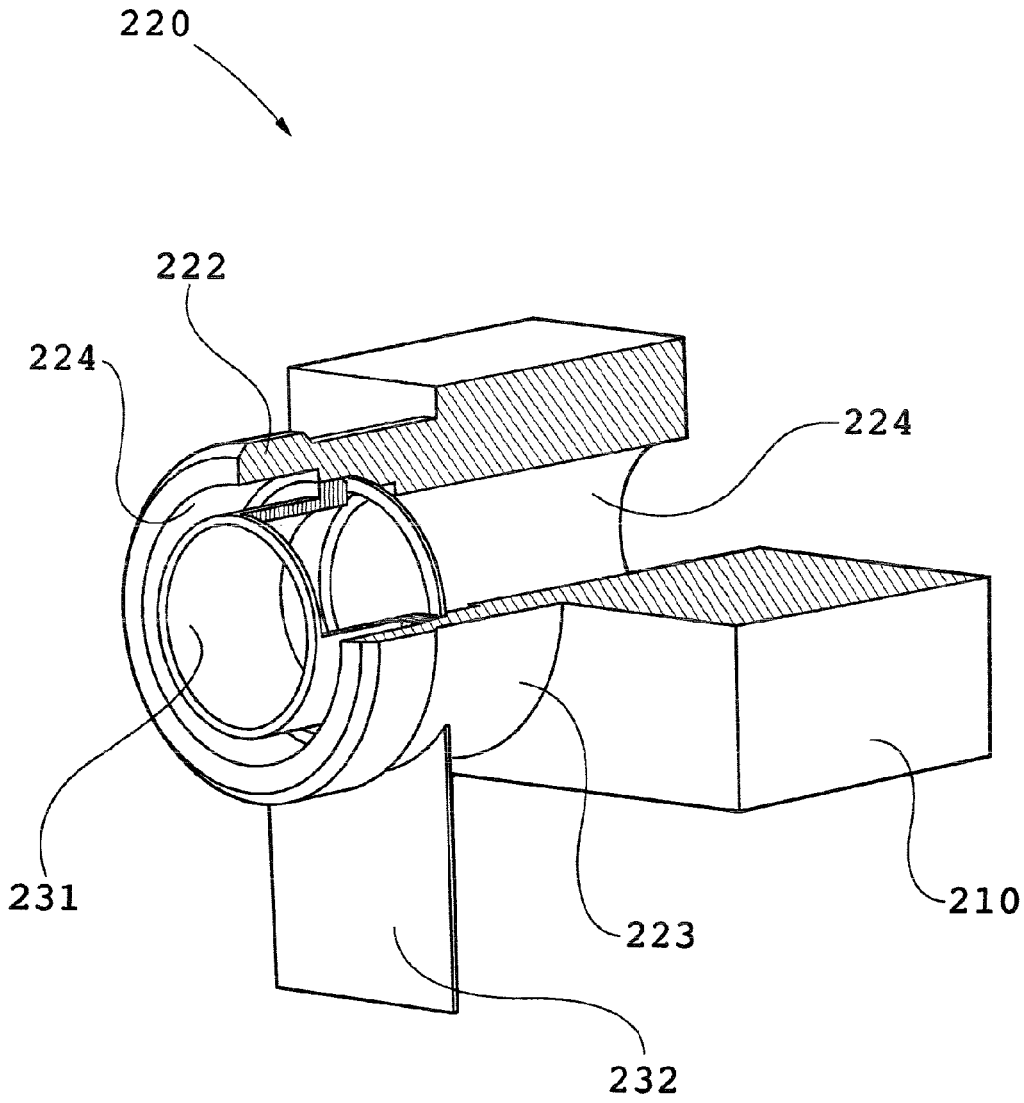
Figure 2D:
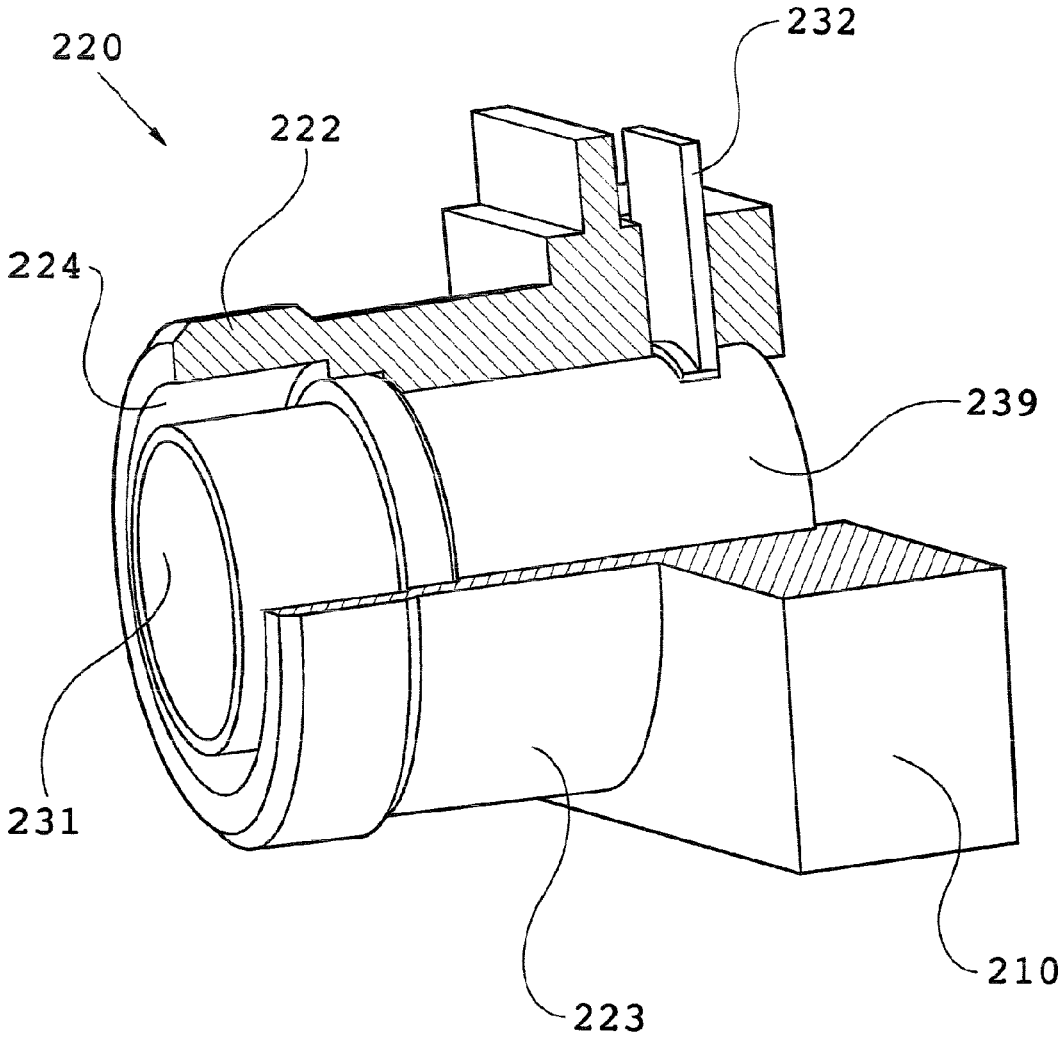

In FIGS. 2*c* and 2*d*, simplified views of different embodiments of the first connector 220 are shown. In FIG. 2*c*, the diversion member 232 is a metal strip having a rounded end portion of its contact portion and being provided with an opening, which in size and shape essentially corresponds to the end portion of the protection sleeve 231. The protection sleeve 231 and the diversion member 232 are here pressed against each other such that electrical contact between them is achieved.

In FIG. 2*d*, the diversion member 232 has a contact portion, the shape of which essentially corresponds to the form of the external wall surface 239 of the protection sleeve. Here, the diversion member 232, and thus the contact portion, is pressed radially against the protection sleeve 231, such that electrical contact between them is achieved. According to an embodiment of the invention, the contact portion of the diversion member is toothed on the surface, which is brought in physical contact with the protection sleeve 231. By this, the teeth are forced into the protection sleeve 231 when the diversion member 232 is pressed axially or radially against the protection sleeve 231, causing a very good electrical contact between them.

Further, in this embodiment, the protection sleeve 231 is essentially cylindrical and extends axially along the full length of the connector body 222, inside the internal wall surface 224, such that one end of the protection sleeve reaches the coating on the inside of the casing walls and another end of the protection sleeve extends to, and possibly through, the free end of the connector body 222. Here, the protection sleeve 231 has a solid essentially cylindrical shape.

However, according to an embodiment of the present invention, the essentially cylindrical shape of the protection sleeve 231 is provided with one or more openings, such as apertures, slots or holes. The one or more openings make the surge protection arrangement lighter. Also, the flexibility thereby achieved for the protection sleeve 231 results in a better electrical contact with a coaxial cable connector being attached to the internal coupling device 230. As stated above, "cylindrical" is here meant to include essentially any cross section shape for the cylinder. Thus, depending on the overall shape of the connector, the shape of the cross section area of the protection sleeve 231 may have any shape. However, the standard 7-16 connectors, and most of the other practically used connectors, use circular shapes, which are dictated by practical engineering and existing cable standards.

According to another embodiment of the present invention, the metallic structure includes a grounding braid, being attached to and in electrical contact with the diversion member 232. The grounding braid is here in permanent electrical contact with ground and is dimensioned so that it has a high capacity of conducting strong currents.

In different embodiments of the present invention, the external wall surface 223 of the connector body, the internal wall surface 224 of the connector body, or both of these wall surfaces 223, 224 are also coated with a thin layer of conducting material. This coating can, especially when it is provided on the internal wall surface 224 of the connector body, convey signalling ground to the coating of the casing walls, from the outer shield conductor of the cable being connected to the first connector 220. However, this coating will not cope with strong currents due to surges, since the thin layer of conducting material, e.g. a thin metallic layer, typically is thinner than 0.2 mm, as was stated above.

Therefore, this coating must also be protected against such surges. This is achieved by the use of the surge protection arrangement of the present invention, including the axially extended protection sleeve 231, the diversion member 232 and the metallic structure, which is permanently in electrical contact with the ground.

There is also a problem present in prior art relating to the stability of the connectors. The connectors are traditionally mounted on the casing by use of screws or the like. It is difficult and expensive to manufacture the casing, the connectors and the screws with such low tolerances that they fit exactly and firmly to the casing.

According to one embodiment of the present invention, the casing 210 and the first and/or second connector 220, 221 are formed in one single piece. Preferably, the casing 210 and the connectors 220, 221 are produced in one piece by moulding, die-casting or the like, depending on the non-conducting material being used. This embodiment has the advantage of being manufactured very easily and at low cost, and also offers very rigid connectors 220, 221, since they do not have to be separately attached to the casing walls 210.

The non-conducting material used for the casing walls 210 and also for the connector bodies 222 is, according to one embodiment of the invention, essentially any non-conducting material being inexpensive, lightweight and easily processed and manufactured. For example, essentially any plastic material can be used. Such non-conducting materials are in need of a conductive coating for providing an efficient RF-path.

The coating of the casing walls 210 is, in relation to the conducting protection sleeve 231, the conducting diversion member 232, and the metallic structure, very thin and of high impedance. According to an embodiment of the invention, the coating has a thickness preferably being less than 0.2 mm and is usually made of a metal, such as copper, silver or aluminium, or possibly yellow chromate or composite layers of several metals.

On the other hand, the protection sleeve 231 has a wall thickness being much larger than the thickness of the coating. According to an embodiment of the invention, the protection sleeve 231 has a wall thickness resulting in a cross sectional area for the protection sleeve 231 being at least 10 $mm^2$. As was stated above, such a cross sectional area is sufficient for coping with most occurring lightning currents.

The coupling sleeve 235 also has cross sectional area being similar to the one of the protection sleeve 231. The diversion member 232 and the metallic structure both have cross section areas being at least 10 $mm^2$. When choosing dimensions for the parts of the surge protection arrangement according to the present invention, the fact that the maximum current density in a particular material limits the peak current amplitude should be taken into consideration, such that contact spots and contact resistance between members are considered accordingly.

According to an embodiment, each one of the protection sleeve 231, coupling sleeve 235, the diversion member 232 and the metallic structure is made of any one of the materials copper or aluminum at their portions having the smallest cross sectional areas, respectively. However, for other portions of these parts than the ones with the smallest cross section areas, or if an overall larger cross section area is chosen, also other metals can be used for these parts of the surge protection arrangement.

Thus, since the impedance of the coating is higher than the impedance of the parts of the surge protection arrangement, i.e. the protection sleeve 231, the diversion member 232 and the metallic structure, the strong currents will prefer to not run through the coating and even more so if the coating tends to heat up during the surge and thereby increasing its impedance. The coating is thereby protected against surges.

For the embodiment of the present invention having a layer of thin coating also on the connector body, on the internal and/or external wall surface 223, 224 of the connector body, this coating is also thin, preferably thinner than 0.2 mm. Further, this thin coating is preferably made from one or more the same materials also being used for coating of the casing.

According to the embodiments shown in FIGS. 2*a* and 2*b*, the first and second connectors are arranged on walls of opposite sides of the casing. However, the connectors may alternatively be arranged on non-opposite sides of the casing, for example of the same side wall, or on two adjacent side walls. Also, in other embodiments of the invention, the number of connectors varies may vary from one connector up to essentially any plurality of connectors, depending on the electrical function of the electronic device.

Above, the first and second connectors 220, 221 have been illustrated as female connectors of the "7-16" connector type. The "7-16" connector is a radio frequency coaxial connector dimensioned such that the centre conductor pin 236 has a diameter of 7 mm, and the coupling and/or the protection sleeve 235, 231 has a diameter of 16 mm. When air is used as dielectric matter between the centre conductor pin 236 and the coupling and/or the protection sleeve 235, 231, the "7-16" connector has an impedance of 50Ω. However, as is clear for a skilled person, essentially any type of connector being possible to accommodate inside the connector body 222 of non-conducting material may be used for implementing the present invention. Such connectors may, e.g., be "41-95" connectors, having a centre conductor pin of 4.1 mm diameter, and a coupling and/or protection sleeve of 9.5 mm Further, the FIGS. 2*a-d* show the first connector 220 as being a female connector. A female connector is provided with threads on the external wall surface 223 of the connector body 222, these threads being arranged so as to engage with threads of a male connector. Such a male connector, e.g. mounted on a coaxial transmission cable, being connected to the female connector, is provided with corresponding treads in a nut-like member being attached to the connector body of the male connector. When connecting the male connector to the female connector, the threads of the nut-like member engage with the threads on the external wall surface of the female connector. When these threads engage with each other, they exert an axial force on the parts of the internal coupling device 230. Thus, the protection sleeve 231 and the diversion member 232 will be pressed together, thereby resulting in a good electrical contact between them. Preferably, the nut-like member should be tightened by the use of a torque corresponding to 25 Nm for "7-16" connectors, which ensures a good contact between both the connectors and also between the parts of the surge protection arrangement.

According to another embodiment of the present invention, the surge protection arrangement of the present invention is accommodated in a male connector. The parts of the internal coupling device, i.e. the protection sleeve and the diversion member, here correspond to the parts of the female connector, although being accommodated inside, and extending through, a non-conducting connector body of a male connector. Also, the protection sleeve here has the shape of a male connector protection sleeve.

Figure 3A:
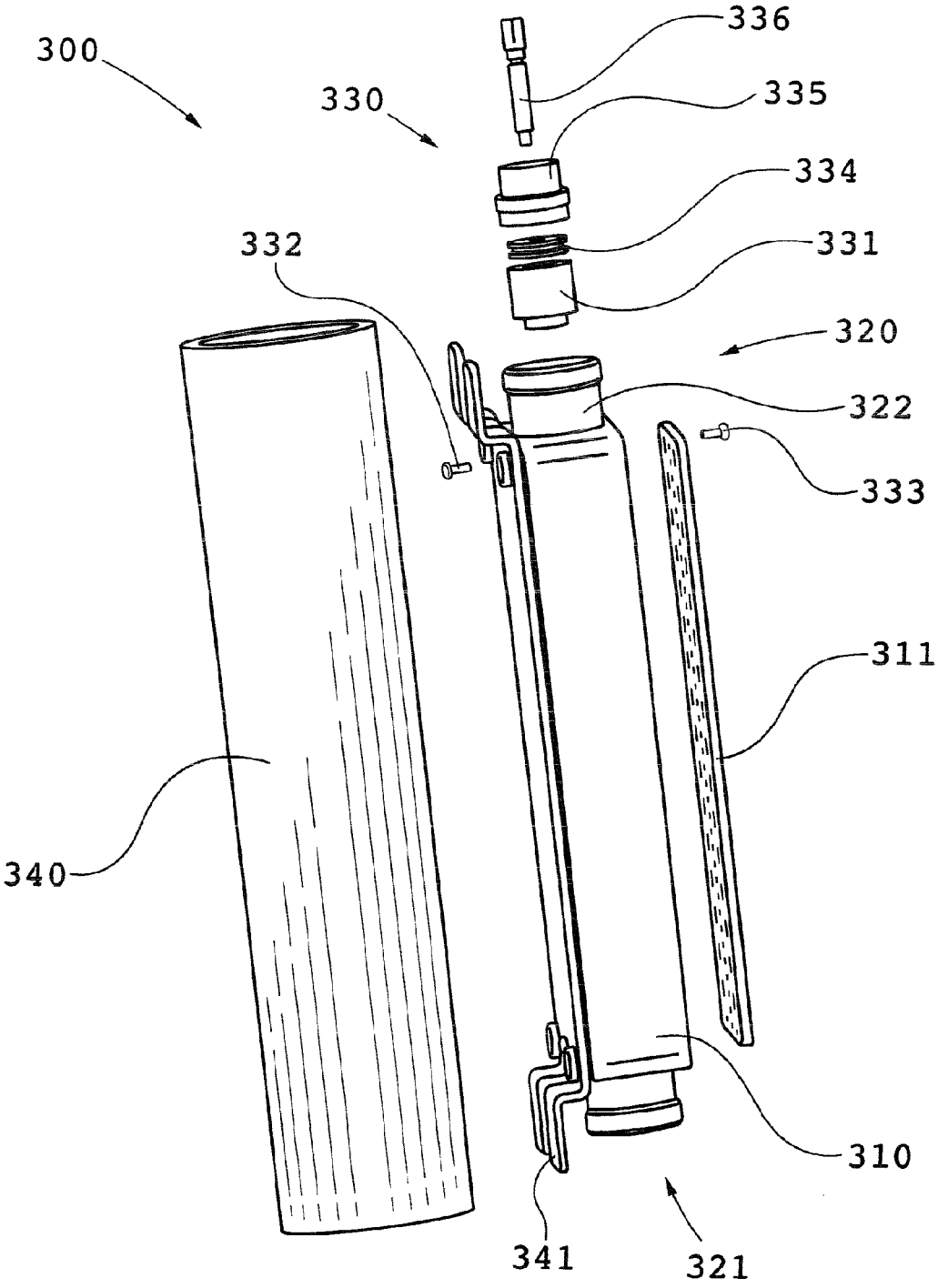
FIGS. 3*a-c* show an electronic device having a surge protection arrangement according to another embodiment of the present invention.
Figure 3B:
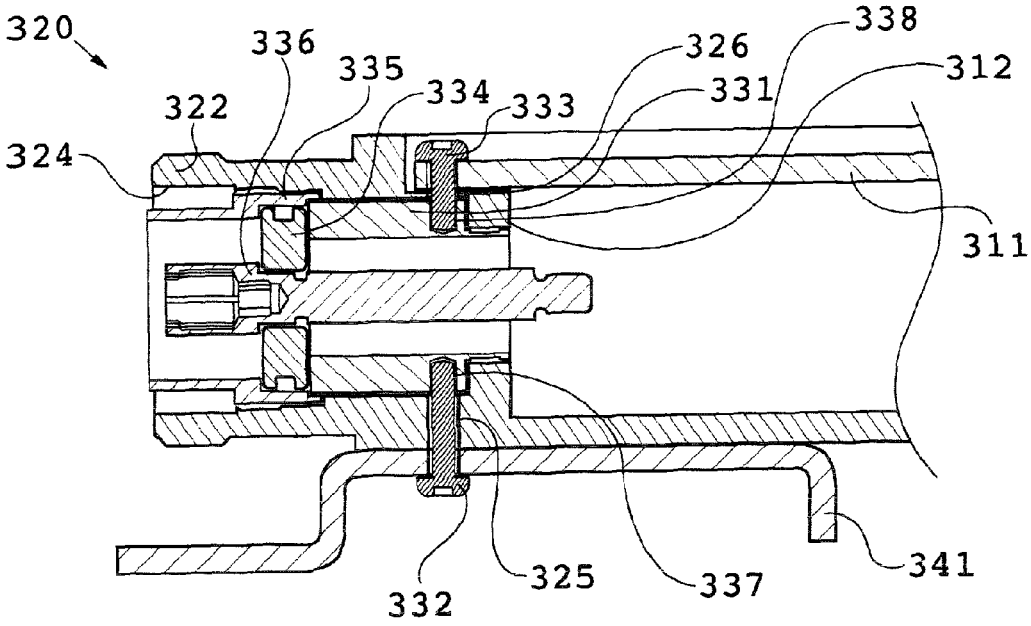
Figure 3C:
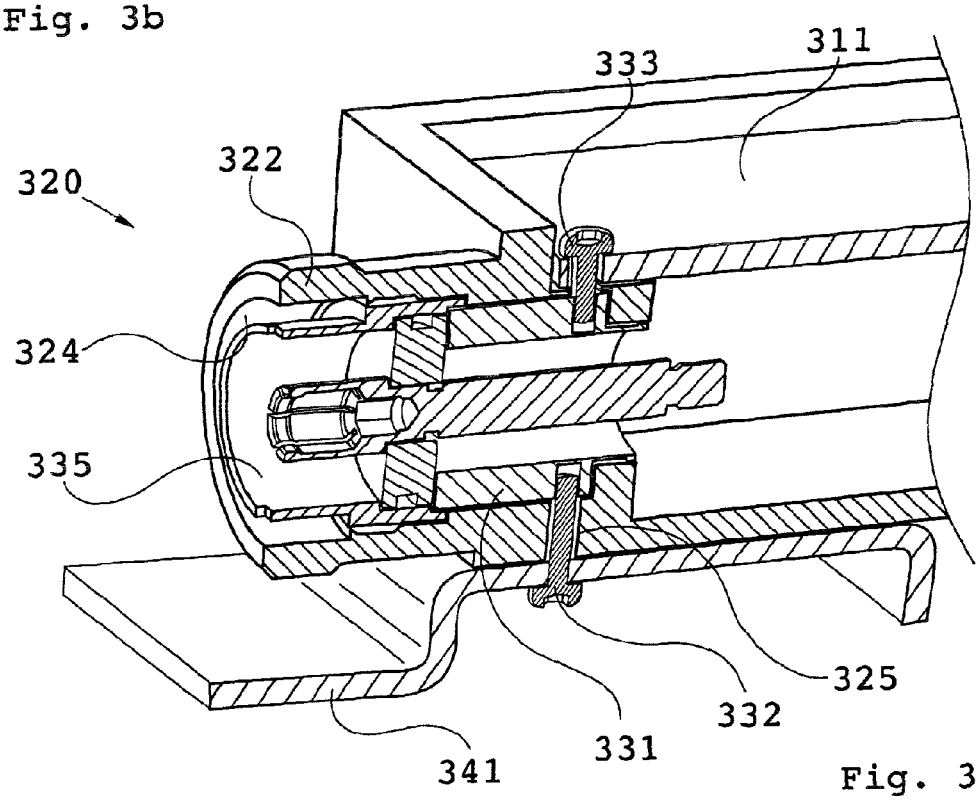

FIGS. 3*a-c* show an embodiment of the present invention, in which a diversion member includes one or more screws diverting the strong currents to a metallic structure. The corresponding parts of FIGS. 3*a-c* have been given the same reference numbers.

In FIG. 3*a*, many parts correspond to the parts previously described in connection with FIGS. 2*a-b*. These parts are side walls and bottom walls of the casing, generally denoted casing walls 310; a lid 311; a first and a second connector 320, 321, each being arranged with a connector body 322 in an opening in the wall on which it is being arranged, and projecting outwardly from the wall; an internal coupling device 330, here being shown in a disassembled fashion; a support construction 340, and a mounting bracket 341. According to an embodiment of the invention, the connector body 322 has a cylindrical shape. Below, the internal coupling device 330 will be described more in detail.

According to the present invention, as was stated in connection with FIGS. 2*a-d*, the casing walls 310 and the connector body 322 are made of a non-conducting material, in order to reduce production costs and weight. To provide signalling ground and interference protection, the casing walls 310 are coated on the inside with a thin layer of a conducting material, and the connector body 322 may also be coated on its internal and/or external surface walls with a thin layer of a conducting material. These coatings need protection against strong currents, since these thin layers of conducting material typically are thinner than 0.2 mm, as was stated above, and preferably are made from one or more the same materials also being used for coating of the casing.

As is shown in FIGS. 3*a*-3*c*, according to this embodiment of the present invention, a diversion member is here implemented as one or more screws 332, 333, inserted into one or more openings 325, 326, preferably holes, in the connector body 322. Threads of the at least one screw 332, 333 are engaged with at least a threaded hole 337, 338 in a protection sleeve, thereby achieving electrical contact between the protection sleeve 331 and the at least one screw 332, 333, i.e. with the diversion member.

Thus, at least one screw 332, 333 extends through the non-conducting connector body 322 and is brought in electrical contact with the conducting protection sleeve 331 of the internal coupling device 330. The protection sleeve 331 is, in use, in electrical contact with the outer shield conductor of a cable being connected to the connector 320, either directly or via the coupling sleeve 335. The at least one screw 332, 333 extends radially outwardly from the protection sleeve and is also brought in electrical contact with a metallic structure, which is made of a rigid and highly conducting material, and is in permanent contact with ground.

Thus, as was stated above in connection with FIGS. 2*a*-2*d*, the protection sleeve, the diversion member and the metallic structure all have low impedance and a high capacity of conducting strong currents. Accordingly, a surge running along the outer shield conductor of a cable being connected to the connector 320, will run trough the coupling and protection sleeves 335, 331 (or through the protection sleeve 331 only if no coupling sleeve is present), the diversion member (i.e. the at least one screw 332, 333), and to the metallic structure, instead of running through, and destroying, the coating of the casing walls 310.

Here, the metallic structure includes the mounting bracket 341, and/or the lid 311, where the lid 311 can be either a simple closing lid, being used just for closing the casing, or a trimming plate, being used also for adjusting characteristics of the electronic device inside the casing, such as resonance characteristics of a filter.

Thus, either of or both of the lid 311 and the mounting bracket 341 can be used as metallic structure, and can thus be used for diverting strong currents from the protection sleeve 331, via the at least one screw 332, 333, in order to protect the coating of the casing walls and/or the connector 320.

FIGS. 3*a*-*c* also show the internal coupling device 330 of a female connector, of this embodiment of the present invention in more detail, in FIG. 3*a* in a disassembled way and in FIGS. 3*b*-*c* in an assembled way. The internal coupling device 330 includes the protection sleeve 331, a centre conductor pin 336, an isolator ring 334, and at least one diversion member, such as one or more screws 332, 333. The internal coupling device can also, depending on the form of the protection sleeve 331, include a separate coupling sleeve 335.

As is shown in FIG. 3*b*, the protection sleeve 331 has an essentially cylindrical shape and is of a solid conducting material. The protection sleeve 331 extends through the connector body 322 inside the internal wall surface 324. One end of the protection sleeve 331 is in direct contact with a coated casing wall 312, and the other end is axially pressed against an essentially cylindrical coupling sleeve 335, which further extends through the connector body 322. Thus, the coupling sleeve 335 also has an essentially cylindrical shape and extends essentially to a free end of the connector body. A good electrical contact is, by the axial force, achieved between the protection sleeve 331 and the coupling sleeve 335. By this configuration, the coupling sleeve 335 is directly contactable with the outer shield conductor of a cable connector being attached to the connector 320, and the protection sleeve 331 is thus, via the coupling sleeve 335, electrically contactable with the outer shield conductor of the cable.

According to another embodiment, the protection sleeve 331 is provided with openings, such as apertures, slots or the like. The protection sleeve 331 may also have different shapes for its cross section area, as appropriately determined by the shape of the connector body 322 and the shape of the other parts of the internal coupling device 330. Also, according to another embodiment, the protection sleeve 331 extends the whole way from a coated casing wall 312, through the whole internal coupling device 330, i.e. along the full length of the connector body 322, inside the internal wall surface 324 of the connector body. Thereby, the protection sleeve 331 is itself in direct contact with the coated casing wall and is also directly connectable to the outer shield conductor of a cable connector being connected to the connector 320.

Thus, in both of the cases where the protection sleeve extends axially along either the full length of or a part of the connector body 322, the protection sleeve 331 is in electrical contact with the outer shield conductor of the cable connector, either by direct contact or via the coupling sleeve 335.

The protection sleeve 331 is here provided with one or more threaded holes 325, 326, into which the one or more screws 332, 333, constituting the diversion member, are secured, in order to provide a good electrical contact between the protection sleeve 331 and the one or more screws 332, 333.

Here, the screw 332 also serves for fastening the electrical device to said mounting bracket, by extending through a hole in the mounting bracket 341, the connector body 322 and into the hole 325 of the protection sleeve 331. The screw 333 also serves for fastening the lid 311 to the casing by extending through a hole in the lid 311, the connector body 322 and into the hole 326 of the protection sleeve 331.

According to other embodiments of the present invention, as described above in connection with the embodiments shown in FIGS. 2*a*-*d*, the diversion member can include a metal strip being inserted, through an aperture in the connector body, into the internal coupling device. In those embodiments, the internal coupling device is similar to the one shown in FIGS. 3*a*-*c*. But, instead of providing the protection sleeve 331 with screw holes 325, 326, the metal strip is inserted into the internal coupling device 330 such that it is pressed against either an end portion of the protection sleeve 331 or against an external wall surface of the protection sleeve 331.

For the embodiments using a metal strip as the diversion member, the metal strip can possibly have a cross sectional area being smaller than the above stipulated approximately 10 $mm^2$ cross section area. However, also diversion members having a cross sectional area being smaller than 10 $mm^2$ can be used for applications having a lower requirement on the level of protection needed.

When assembling the internal coupling device 320 within the connector body 322, as can be seen in FIG. 3*b*, the isolator ring 334 is pressed between a rim in the coupling sleeve 335 and the protection sleeve 331, which in turn is pressed against a rim in the connector body 322. The centre conductor pin 336 is inserted into the central hole of the isolator ring 334 and is kept in place by the isolator ring 334. By this construction, a very rigid internal coupling device is achieved, which also provides very good electrical contact between the conducting parts of the internal coupling device. Further, the protection sleeve 331 is also in electric contact with the coated casing wall 312, such that it can convey signalling ground, from the outer shield conductor of the cable being connected to the connector, to the coating.

Figure 4:
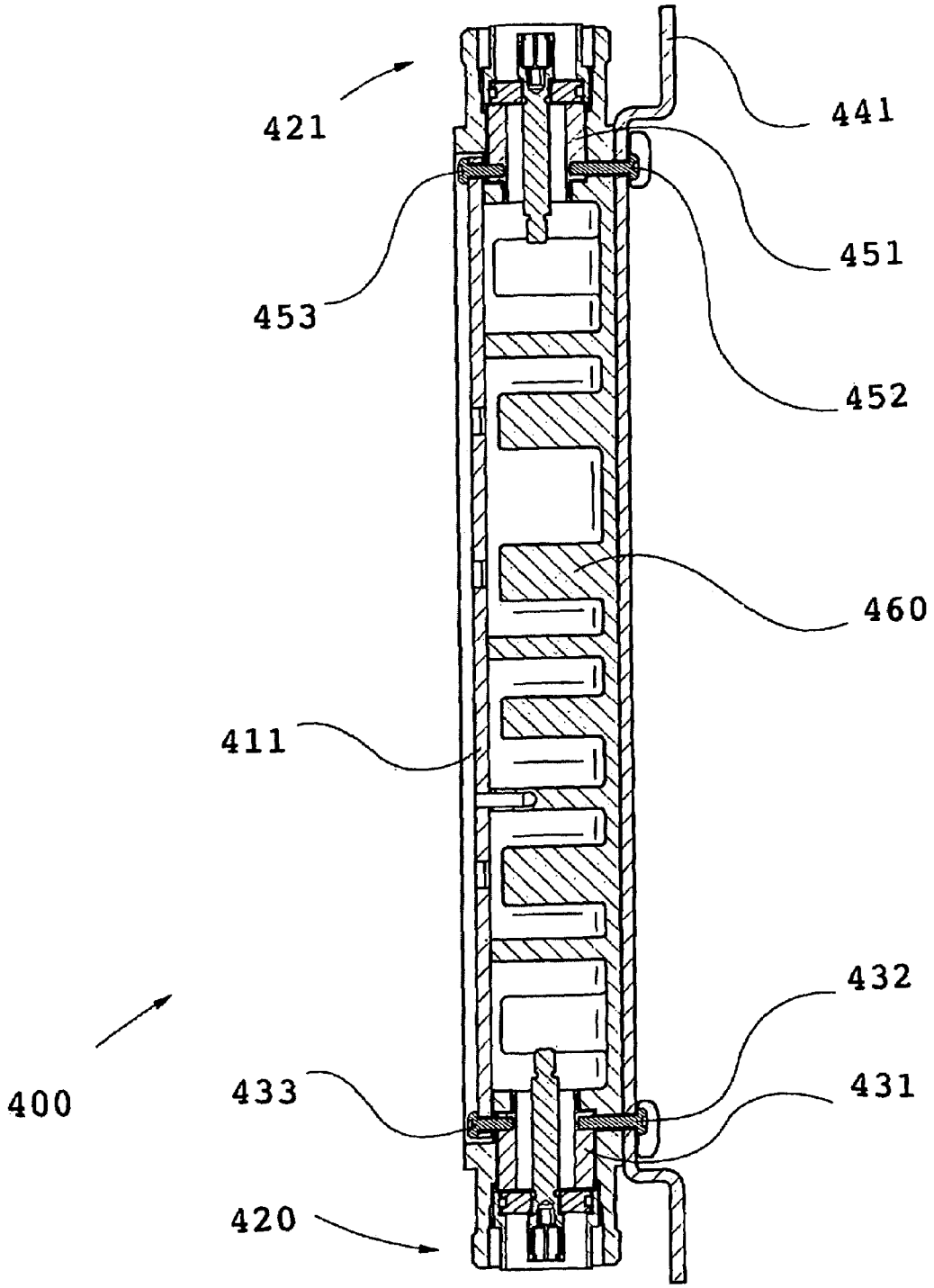
FIG. 4 shows a cross-sectional view of an electronic device having a surge protection arrangement according to the present invention.

FIG. 4 shows a cross-sectional view of a device according to the present invention, having two connectors and also a plurality of filter resonators 460 inside the casing. Strong currents arriving at the protection sleeve 431 of a first connector 420, will here be diverted from the protection sleeve 431, via the screw 432 and the mounting bracket 441, and be led to the support construction and further to ground. Thereby, the strong currents are lead away from the thin and sensitive coating of the device. The strong currents can also, via either or both of the mounting bracket 441 and the lid 411, be lead to bypass the casing from the first connector 420 to the second connector 421.

In the latter case, the strong currents are diverted from the protection sleeve 431 of the first connector 420, are lead through the diversion member, being either or both of the screws 332, 333, through the metallic structure, being either or both of the mounting bracket 441 and the lid 411, through a diversion member of the second connector 421, being either or both of the screws 452, 453, and to the protection sleeve 451 of the second connector 421, which is in electrical contact with an outer shield conductor of a cable being connected to it and being in permanent electrical contact with ground.

Thus, a strong current occurring on the outer shield conductor of a cable being connected to a first connector 420 is, by the surge protection arrangement of this embodiment, led to ground or is bypassed in parallel to the thin layer or layers of coating being present in the electronic device 400.

FIG. 4 illustrates the principle for bypassing or leading strong currents to ground for an embodiment of the present invention. However, this principle also applies for the other embodiments of the invention, for example where the one or more diversion members include metal strips, where a grounding braid is used, where the number of connectors is other than two, and where the connectors are not arranged on opposite side walls.

The surge protection arrangement according to the invention may be modified by those skilled in the art, as compared to the exemplary embodiments described above. Especially, the connectors have in this specification been described in form of so called "7-16" connectors and "41-95" connectors. However, as is clear to a skilled person, the invention is also applicable to other kinds of connectors being made of non-conducting material, male or female. Thus, the connectors of the device may also be male connectors, being provided with treads in a nut-like member being attached to the connector body.

Further, the surge protection arrangement has above been illustrated for two connectors of opposite sides of the casing. As is clear for a skilled person, the teachings of the present invention are also applicable on devices having essentially any number of connectors, being located on opposite or non-opposite sides of the casing. According to the invention, when the number of connectors is one, a protection sleeve of that connector is, via a diversion member, in electrical contact with at least one metallic structure, leading the strong current to ground. When the number of connectors is at least two, the strong current is lead to ground in the same way as for one connector and/or is bypassing the casing, by having a protection sleeve in each of those connectors, via a diversion member, in electrical contact with the at least one metallic structure, respectively. Thereby, a strong current being present at the protection sleeve of one of the connectors is bypassed to the protection sleeves of the other connectors.

The invention claimed is:

1. A surge protection arrangement, for protecting an electronic device provided with a closed casing, said casing including side and bottom walls made of a non-conducting material and being internally coated with a thin metallic layer, and at least one connector formed integral with the closed casing, being arranged in an opening in one of said walls and including a connector body, at least a portion of which projects outwardly from said wall and which accommodates an internal coupling device, to which a transmission cable, including a central conductor and an outer shield conductor, is connectable, wherein said connector body is made of a non-conducting material, said connector body is essentially cylindrical and radially surrounds said internal coupling device, and said internal coupling device includes a conducting protection sleeve, in use being in electrical contact with said outer shield conductor of said transmission cable, and at least one conducting diversion member, in use being in electrical contact with said protection sleeve, and extending radially outwardly from said protection sleeve, through said connector body, electrically bypassing the thin metallic layer on the casing interior to at least one metallic structure being in permanent electric contact with ground and having a high capacity of conducting strong currents.

2. The surge protection arrangement as claimed in claim 1, wherein said at least one metallic structure includes one or more of the following: a mounting bracket, attaching said device on a support construction; a lid closing the casing; a lid including a trimming plate; a grounding braid; a support construction, on which said device is attached.

3. The surge protection arrangement as claimed in claim 1, wherein said diversion member includes a metal strip.

4. The surge protection arrangement as claimed in claim 3, wherein said metal strip has a contact portion, having a circular opening essentially corresponding in shape to an end portion of said protection sleeve, whereby said contact portion, in use, is pressed axially against said end portion, thereby achieving electrical contact with said protection sleeve.

5. The surge protection arrangement as claimed in claim 3, wherein said metal strip has a contact portion being configured so as to essentially correspond to the shape of an external wall surface of said protection sleeve, whereby said contact portion, in use, is pressed radially against said external wall surface of said protection sleeve, thereby achieving electrical contact with said protection sleeve.

6. The surge protection arrangement as claimed in claim 1, wherein said diversion member includes at least one screw, said at least one screw being screwed into said protection sleeve.

7. The surge protection arrangement as claimed in claim 6, wherein said at least one screw also serves for fastening said electrical device to a mounting bracket.

8. The surge protection arrangement as claimed in claim 6, wherein at least one screw also serves for fastening a lid to said casing.

9. The surge protection arrangement as claimed in claim 1, wherein said protection sleeve is essentially cylindrical and extends axially inside said connector body, such that it is contactable directly to said shield outer conductor.

10. The surge protection arrangement as claimed in claim 1, wherein said protection sleeve is essentially cylindrical and extends axially inside said connector body, such that it is contactable to said shield conductor via a coupling sleeve, said coupling sleeve being directly contactable to said outer shield conductor.

11. The surge protection arrangement as claimed in claim 1, wherein said protection sleeve is also in electrical contact with the thin metallic layer of said casing, thereby connecting a signaling ground of said outer shield conductor to said thin metallic layer.

12. The surge protection arrangement as claimed in claim 1, wherein an external wall surface of said connector body is coated with a thin metallic layer.

13. The surge protection arrangement as claimed in claim 1, wherein an internal wall surface of said connector body is coated with a thin metallic layer.

14. The surge protection arrangement as claimed in claim 13, wherein the coating of the internal wall surface of said connector body connects a signaling ground of said outer shield conductor to the thin metallic layer of said casing.

15. The surge protection arrangement as claimed in claim 1, wherein said device includes two connectors, where said at least one metallic structure, in each of said two connectors, via said diversion member, is in electrical contact with said protection sleeve, respectively.

16. The surge protection arrangement as claimed in claim 1, wherein said casing and said at least one connector are formed in one piece.

* * * * *